US010393354B2

(12) United States Patent
Schneider

(10) Patent No.: US 10,393,354 B2
(45) Date of Patent: Aug. 27, 2019

(54) LIGHT ASSEMBLY AND ALIGNMENT DEVICE

(71) Applicant: Andrew Michael Schneider, Greenleaf, WI (US)

(72) Inventor: Andrew Michael Schneider, Greenleaf, WI (US)

(73) Assignee: Andrew Michael Schneider, Greenleaf, WI (US)

( * ) Notice: Subject to any disclaimer, the term of this patent is extended or adjusted under 35 U.S.C. 154(b) by 0 days.

(21) Appl. No.: 15/785,125

(22) Filed: Oct. 16, 2017

(65) Prior Publication Data

US 2018/0119934 A1 May 3, 2018

Related U.S. Application Data

(60) Provisional application No. 62/414,241, filed on Oct. 28, 2016.

(51) Int. Cl.

| | |
|---|---|
| ***F21V 21/112*** | (2006.01) |
| ***F21S 8/06*** | (2006.01) |
| ***F21V 21/008*** | (2006.01) |
| ***F21V 21/104*** | (2006.01) |
| ***F21S 8/04*** | (2006.01) |
| *F21V 21/02* | (2006.01) |
| *F21V 29/74* | (2015.01) |
| *F21V 29/83* | (2015.01) |

(52) U.S. Cl.

CPC ..... *F21V 21/112* (2013.01); *F21S 8/04* (2013.01); *F21S 8/061* (2013.01); *F21S 8/063* (2013.01); *F21V 21/008* (2013.01); *F21V 21/104* (2013.01); *F21V 21/02* (2013.01); *F21V 29/74* (2015.01); *F21V 29/83* (2015.01)

(58) Field of Classification Search

None

See application file for complete search history.

(56) References Cited

U.S. PATENT DOCUMENTS

| | | | | |
|---|---|---|---|---|
| 2,867,404 A * | 1/1959 | Ramsing | ..... | F21S 8/06 248/324 |
| 2,953,109 A | 9/1960 | Albert | | |
| 4,044,246 A | 8/1977 | Docimo et al. | | |

(Continued)

FOREIGN PATENT DOCUMENTS

| | | |
|---|---|---|
| KR | 20120001918 | 3/2012 |
| KR | 20160000627 | 2/2016 |
| WO | 2017059538 | 3/2017 |

*Primary Examiner* — Elmito Breval

(74) *Attorney, Agent, or Firm* — Brannen Law Office, LLC

(57) ABSTRACT

The present invention relates to an improved light assembly and alignment device. One embodiment of the assembly can have a spacer, a lid, a rod, a bracket, a guide, electronics, a cover and a nut. The spacer has a perimeter sidewall that is vented. A guide having a keeper and a body can be passed through a hole in the bracket. The rod can receive the body of the guide wherein the rod is aligned with the hole in the bracket. A nut at an end of the rod supports the cover by preventing it from sliding off from the end of the rod. The nut also is used to turn the rod so that it advances through the bracket hole to raise the assembly to the ceiling. Another embodiment has a square nut that is seated in a bracket when the rod is passed through a bracket slot.

7 Claims, 15 Drawing Sheets

(56) References Cited

U.S. PATENT DOCUMENTS 5,672,002 A * 9/1997 Todd, Jr. ..... F04D 25/088 362/294
5,899,663 A * 5/1999 Feder ..... F04D 29/646 416/5
5,947,436 A * 9/1999 Bucher ..... F04D 29/601 248/27.1
6,062,816 A * 5/2000 Chang ..... F04D 25/088 362/249.01
6,086,226 A * 7/2000 Chang ..... F21V 33/0096 362/147
6,089,725 A * 7/2000 Chen ..... F04D 25/088 362/149
6,176,736 B1 1/2001 Hsu
6,322,232 B1 11/2001 Oliver
6,364,612 B1 4/2002 Tseng
6,665,170 B1 12/2003 Warner et al.
6,682,303 B2 1/2004 Wu
7,165,863 B1 1/2007 Thomas et al.
8,035,284 B2 10/2011 Hasnain
8,469,560 B2 6/2013 Tarr et al.
9,175,874 B1 * 11/2015 Tom ..... F04D 19/00
9,249,952 B2 2/2016 Markle et al.
9,310,038 B2 4/2016 Athalye
2004/0091362 A1 5/2004 Tseng
2004/0095752 A1 5/2004 Hsu
2004/0115062 A1 * 6/2004 Pearce ..... F04D 25/088 416/244 R
2006/0255226 A1 11/2006 Frampton et al.
2006/0285357 A1 * 12/2006 Shyu ..... F21S 8/04 362/611
2007/0009362 A1 1/2007 Tseng
2007/0183138 A1 * 8/2007 Cooper ..... F21V 21/03 362/147
2008/0013327 A1 1/2008 Higgins et al.
2008/0122364 A1 5/2008 McClellan
2009/0034247 A1 2/2009 Boyer
2009/0073680 A1 * 3/2009 Sandoval ..... F21S 8/06 362/216
2012/0112615 A1 5/2012 Kuenzler
2014/0119030 A1 * 5/2014 Ohai ..... F21V 17/06 362/311.01
2014/0355302 A1 12/2014 Wilcox et al.
2015/0009666 A1 * 1/2015 Keng ..... F21V 23/005 362/235
2015/0276197 A1 * 10/2015 Horng ..... F21V 29/60 362/294
2016/0153643 A1 6/2016 Schneider
2017/0055767 A1 * 3/2017 Brown ..... A47J 37/041
2017/0314771 A1 * 11/2017 Valtchev ..... B25B 27/14
2018/0080645 A1 * 3/2018 Tsai ..... F21V 33/0096

* cited by examiner

LIGHT ASSEMBLY AND ALIGNMENT DEVICE

This patent application claims priority on and the benefit of provisional application 62/414,241 filed Oct. 28, 2016, the entire contents of which are hereby incorporated herein by reference.

BACKGROUND OF THE INVENTION

1. Field of the Invention

The present invention relates to an improved light assembly and alignment device.

2. Description of the Related Art

It is typical for light assemblies or fixtures to be hung from or supported by the ceiling. The installation of the fixtures can be problematic because the installer typically has to thread a rod into a hole of a bracket while not being able to see the hole. It can be challenging to find a blind hole while supporting the weight of the fixture.

Thus, there exists a need for an improved light assembly and alignment device that solves these and other problems.

SUMMARY OF THE INVENTION

The present invention relates to an improved light assembly and alignment device. One embodiment of the assembly can have a spacer, a lid, a rod, a bracket, a guide, electronics, a cover and a nut. The spacer has a perimeter sidewall that is vented. A guide having a keeper and a body can be passed through a hole in the bracket. The rod can receive the body of the guide wherein the rod is aligned with the hole in the bracket. A nut at an end of the rod supports the cover by preventing it from sliding off from the end of the rod. The nut also is used to turn the rod so that it advances through the bracket hole to raise the assembly to the ceiling. Another embodiment has a square nut that is seated in a bracket when the rod is passed through a bracket slot.

According to one advantage of the present invention, a guide is provided. In this regard, the installer is able to quickly and accurately install the assembly onto a bracket secured to the ceiling electrical box.

According to another advantage of the present invention, the guide can be used with a mounting bracket or a modified mounting bracket. In this regard, a keeper is provided and a body can depend therefrom through the mounting hole on the bracket.

Related, as a rod of the assembly is turned into the hole, the keeper is guided upwards atop the end of the rod. In this regard, the guide can stay in place, concealed within the rod, when the assembly is installed.

According to another advantage of the present invention, a spacer is provided having vents. The vents allow for airflow to pass through the assembly above the electronics. A fan can be optionally provided to assist in moving air over the electronics if increased heat removal is desired.

According to a still further advantage of the present invention, a lid is provided to conceal the electronics when the assembly is not installed. Also, the lid keeps the electronics segregated from the ceiling and the electric box as a safety feature.

According to a further advantage of the present invention, a bottom nut is provided to securing to one end of the rod. A clip is also provided, wherein the clip and nut can secure the assembly in an assembled manner. The nut can also be rotated, causing the rod to rotate therewith, to selectively raise and lower the assembly by turning the rod further into or out of the bracket hole. The assembly can be raised until it flushly engages the ceiling.

According to a still further advantage yet of the present invention, the cover has a lip that is received within a rim of the spacer. The lip and spacer can be generally circular whereby the assembly is symmetrical about a vertical axis. The cover can have other shapes without departing from the broad aspects of the present invention.

According to an advantage of an alternative embodiment of the present invention, a nut can be provided that can be seated in a bracket. The nut can first be threadably secured to the rod and then seated in the bracket. Then, the rod can be turned relative to the nut while the bracket sidewalls prevent the nut from rotating in order to raise the light assembly to the ceiling.

Advantageously, the bracket can have a slotted side that allows the shaft of the rod to enter the bracket and the nut to be engaged by the sidewalls of the bracket.

According to another advantage of the present invention, the bracket can have one or more arms that prevent the nut from slipping laterally off of the bracket during installation. When the assembly is fully installed flush against the ceiling, a friction force between the assembly and ceiling can alternatively or additionally act secure the assembly in place.

According to an advantage of a further alternative embodiment, an elongated shaft can be provided so that the light assembly is secured a predetermined distance from the ceiling.

Other advantages, benefits, and features of the present invention will become apparent to those skilled in the art upon reading the detailed description of the invention and studying the drawings.

DETAILED DESCRIPTION OF PREFERRED EMBODIMENTS

Figure 1:
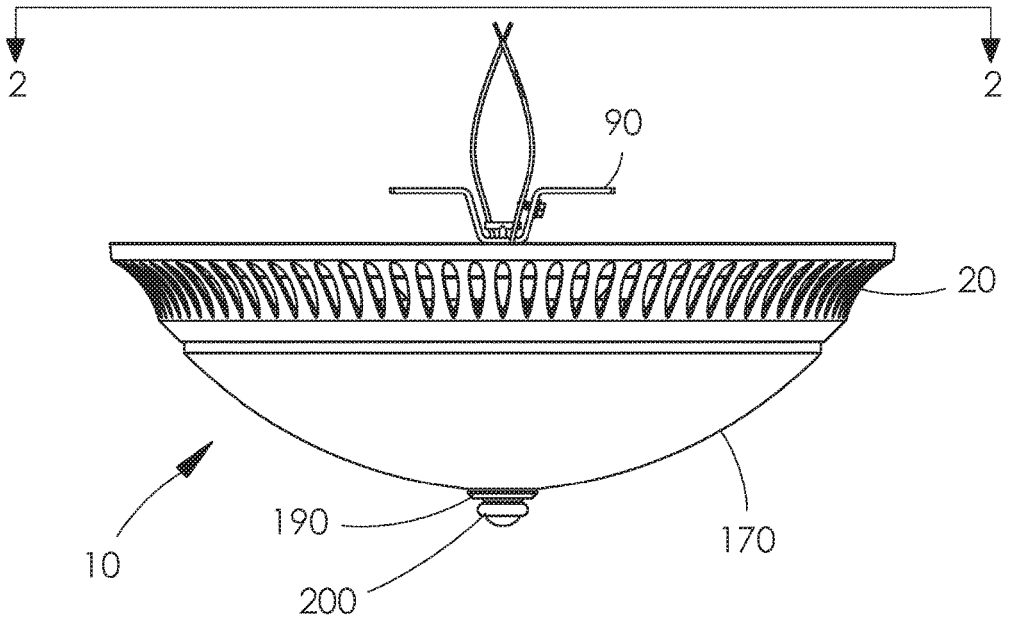
FIG. 1 is a side view of a preferred embodiment of the present invention in an assembled state.
Figure 2:
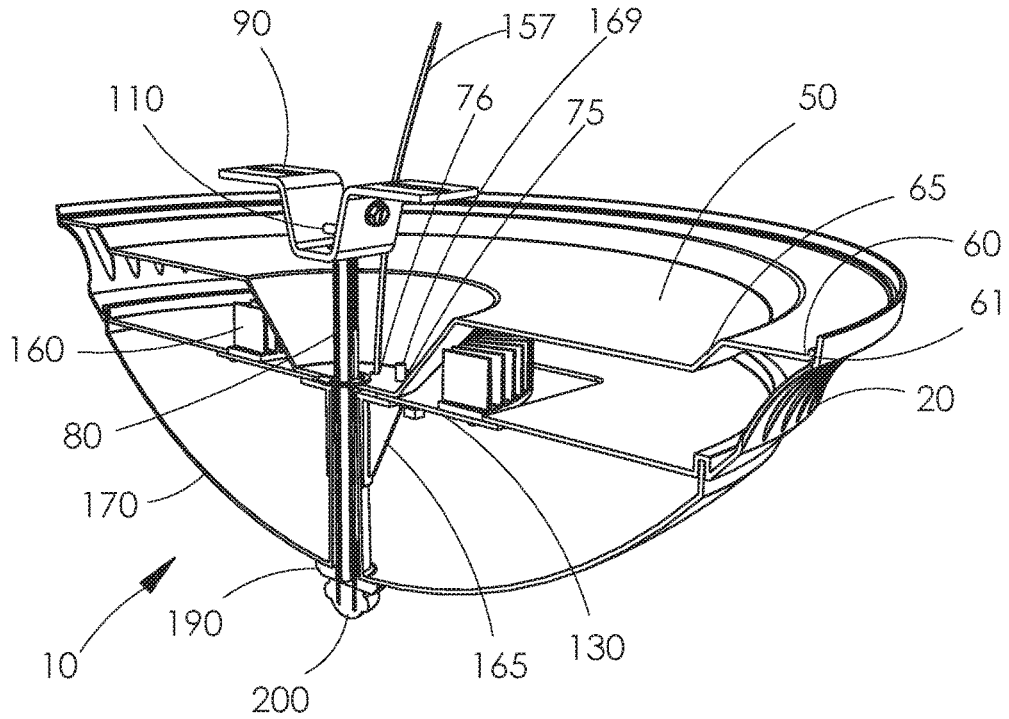
FIG. 2 is a cross-sectional line taken along line 2-2 in FIG. 1.
Figure 3:
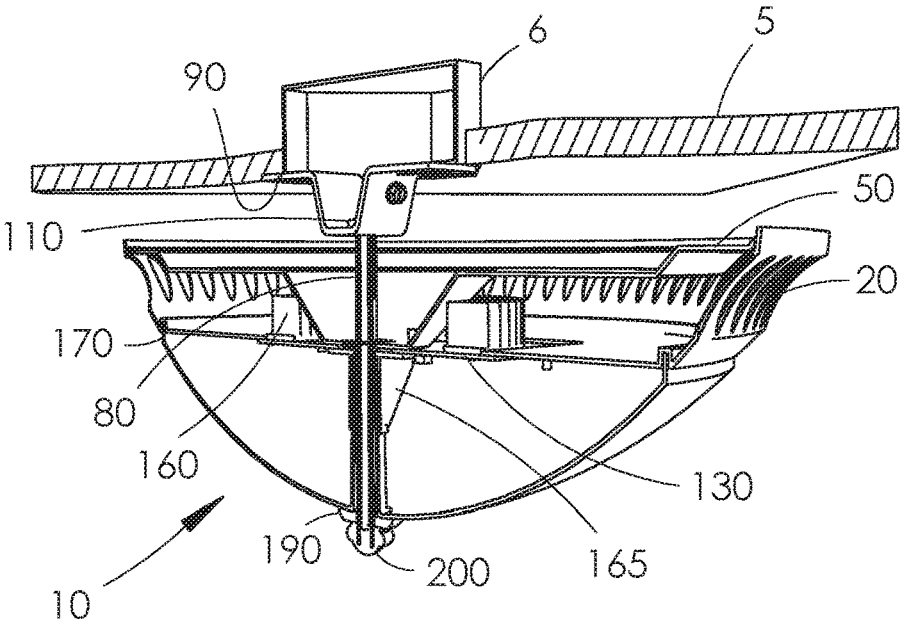
FIG. 3 is similar to FIG. 2, but shows a sectional view of the illustrated embodiment adjacent the ceiling just prior to having the rod engage the bracket.
Figure 4:
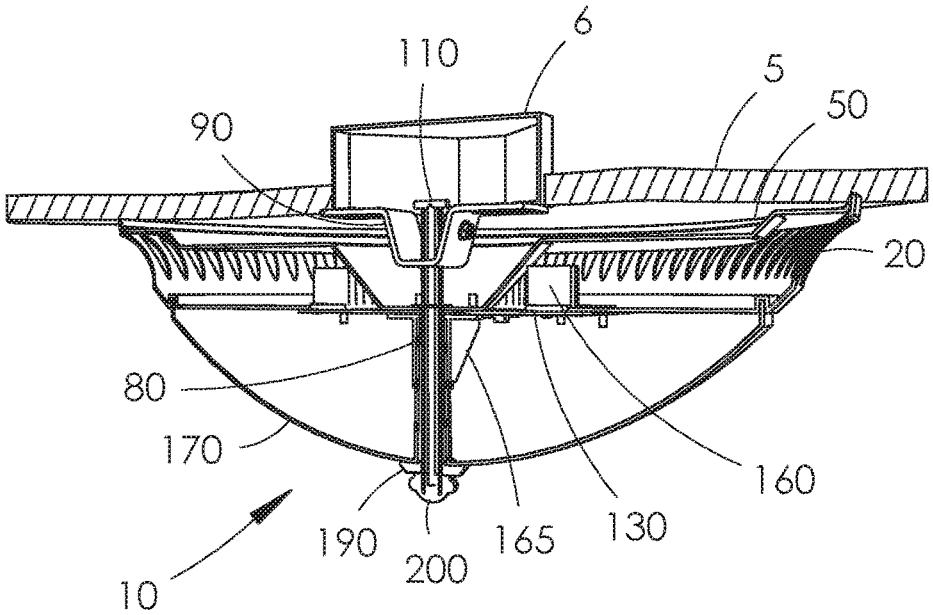
FIG. 4 is similar to FIG. 3, but shows the illustrated embodiment in a raised position flush with the ceiling.
Figure 5:
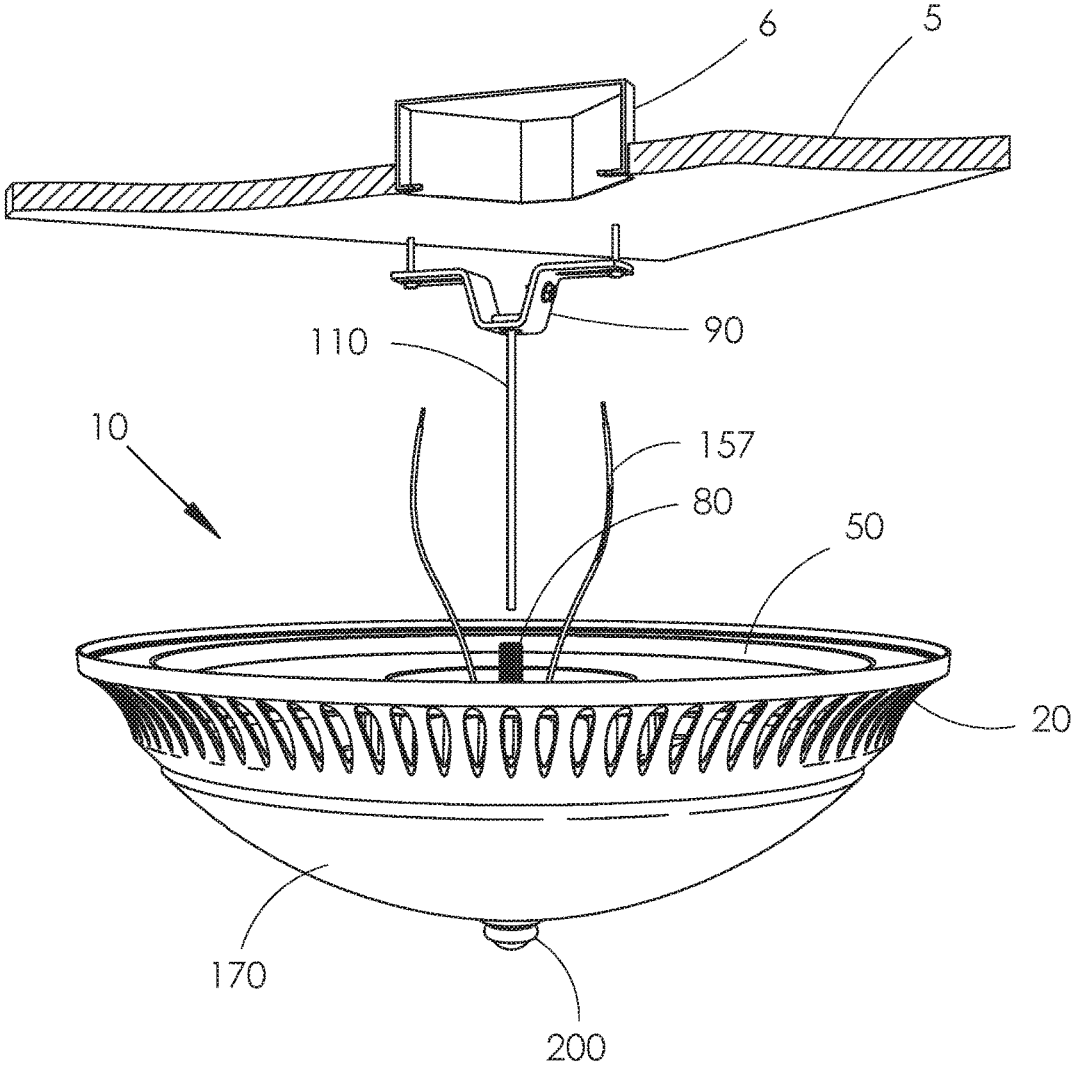
FIG. 5 is a partially exploded view of the embodiment illustrated in FIG. 1.
Figure 6:
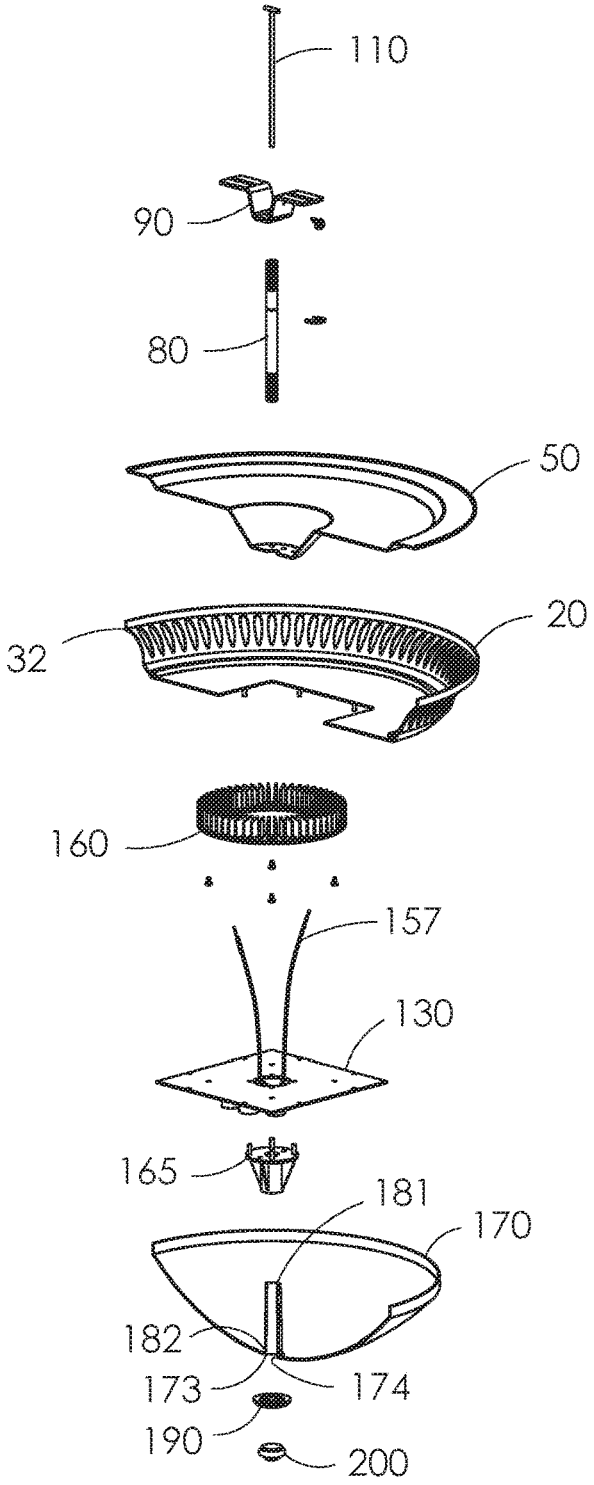
FIG. 6 is a fully exploded view of the embodiment illustrated in FIG. 1.

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

Turning now to FIGS. 1-6, it is seen that a preferred embodiment of the present invention is illustrated. A light assembly 10, or simply assembly or fixture, is shown in relation to a ceiling 5 adjacent the recessed electrical box 6. The assembly 10 has a spacer 20, a lid 50, a rod 80 a bracket 90, a guide 110, electronics 130, a heat sink 160, a lifter 165, a cover 170, a washer 190 and a nut 200. Each of these components are described in detail below. It is appreciated that these components are not all required components for each inventive aspect of the present invention.

The spacer 20 is best seen in FIGS. 1-6 and 8. Spacer 20 has a perimeter 30 that is preferably round in profile. The perimeter 30 has a top 31 with a catch 32. The perimeter 30 also has a bottom 33 with a channel 34. A sidewall 35 spans between the top 31 and bottom 33. The sidewall has a plurality of vents 36 spaced radially around the spacer 20. The sidewall 35 can be angled generally outwardly from bottom to top, so that the diameter is larger at the top 31 than at the bottom 33. A center 40 is provided. A preferably generally square opening 41 is provided. Posts 42 are spaced about the hole or opening 41. There are eight posts 42 in the preferred embodiment. However, there could be more or fewer without departing from the broad aspects of the present invention. The posts depend from the bottom 33 of the spacer and each have a longitudinal axis that is parallel to each other.

Figure 7:
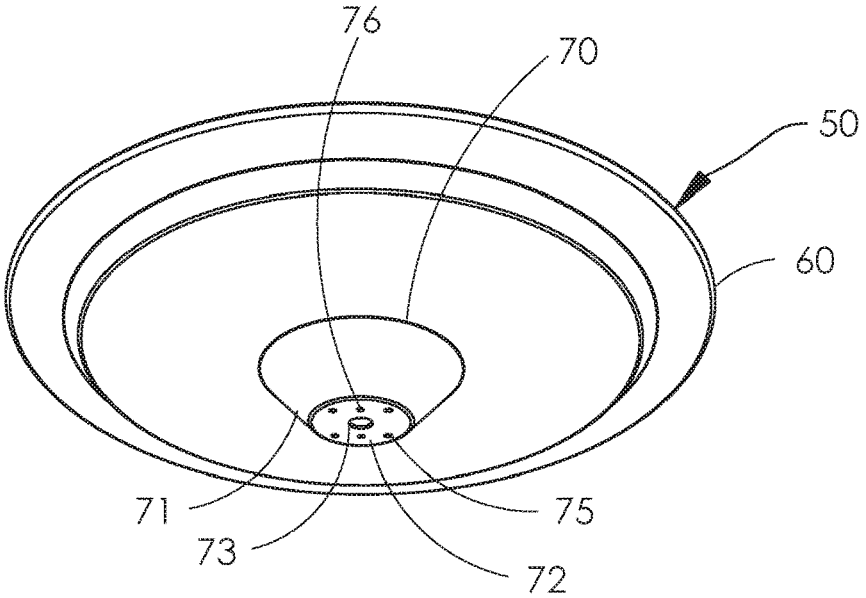
FIG. 7 is an isolation perspective view of an embodiment of a lid of the present invention.
Figure 8:
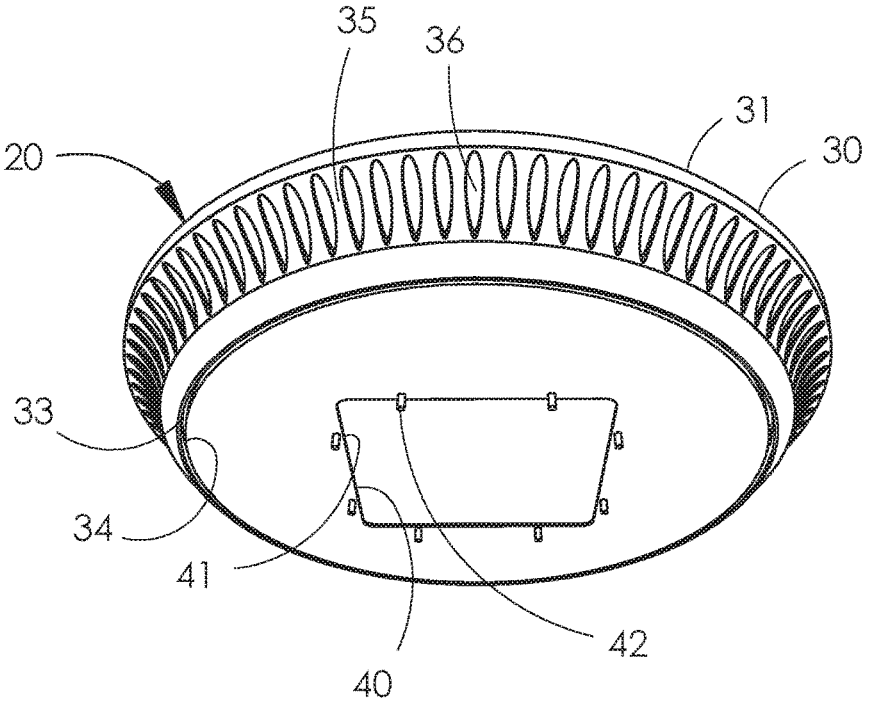
FIG. 8 is an isolation perspective view of an embodiment of a spacer of the present invention.
Figure 9:
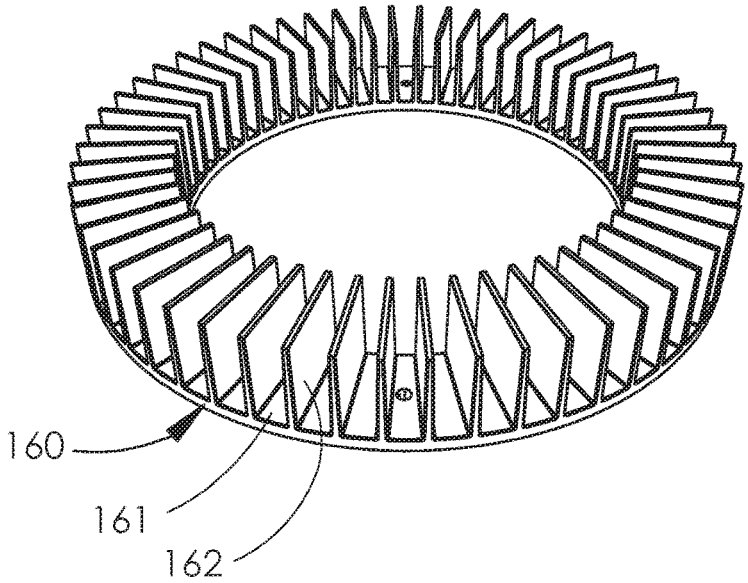
FIG. 9 is an isolation perspective view of an embodiment of a heat sink of the present invention.
Figure 10:
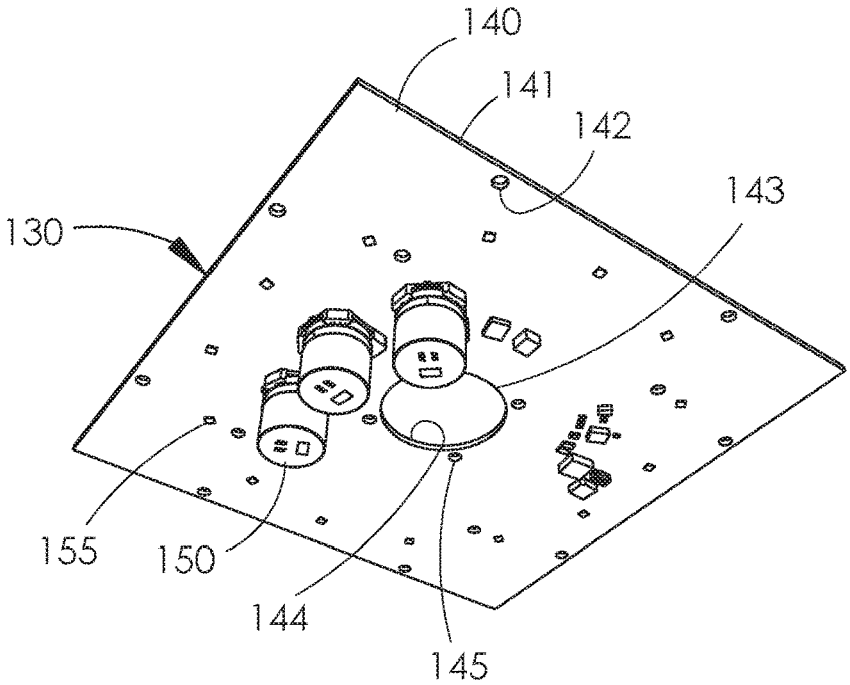
FIG. 10 is an isolation perspective view an embodiment of electronics of the present invention.
Figure 11:
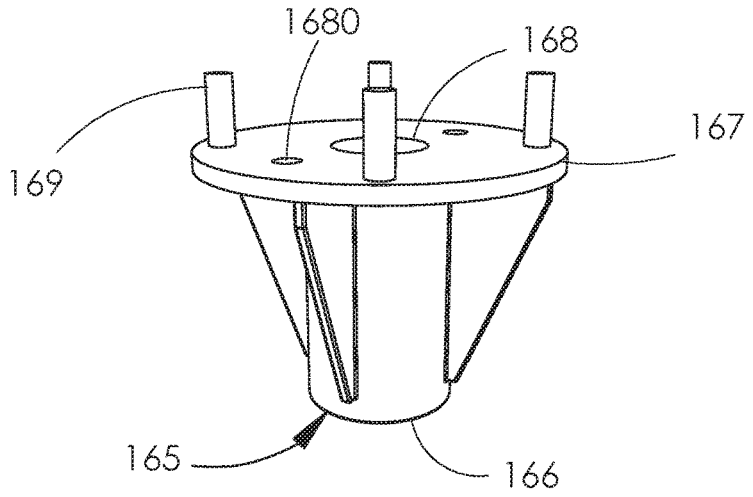
FIG. 11 is an isolation perspective view of an embodiment of a lifter of the present invention.
Figure 12:
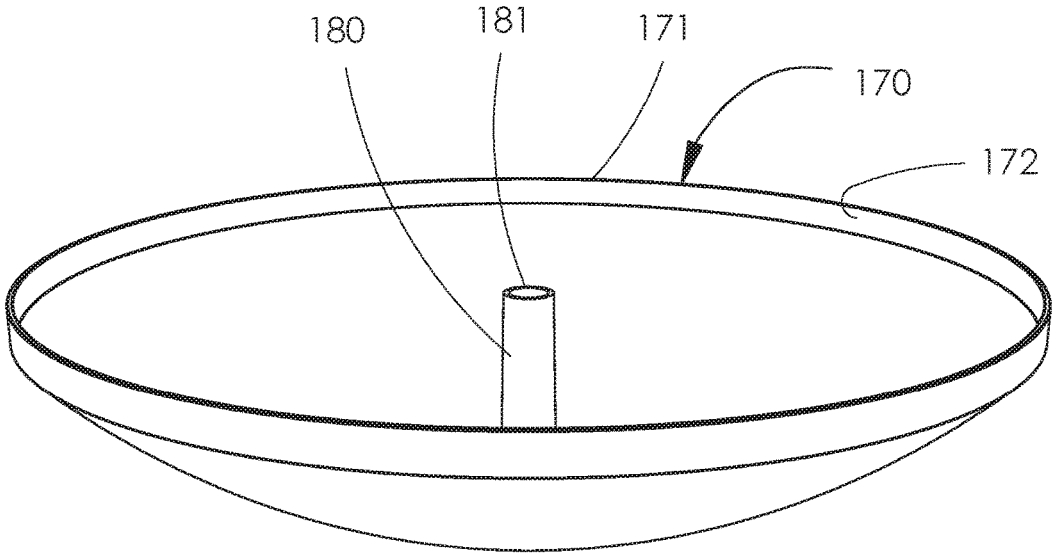
FIG. 12 is an isolation perspective view of a cover of an embodiment of the present invention.
Figure 13:
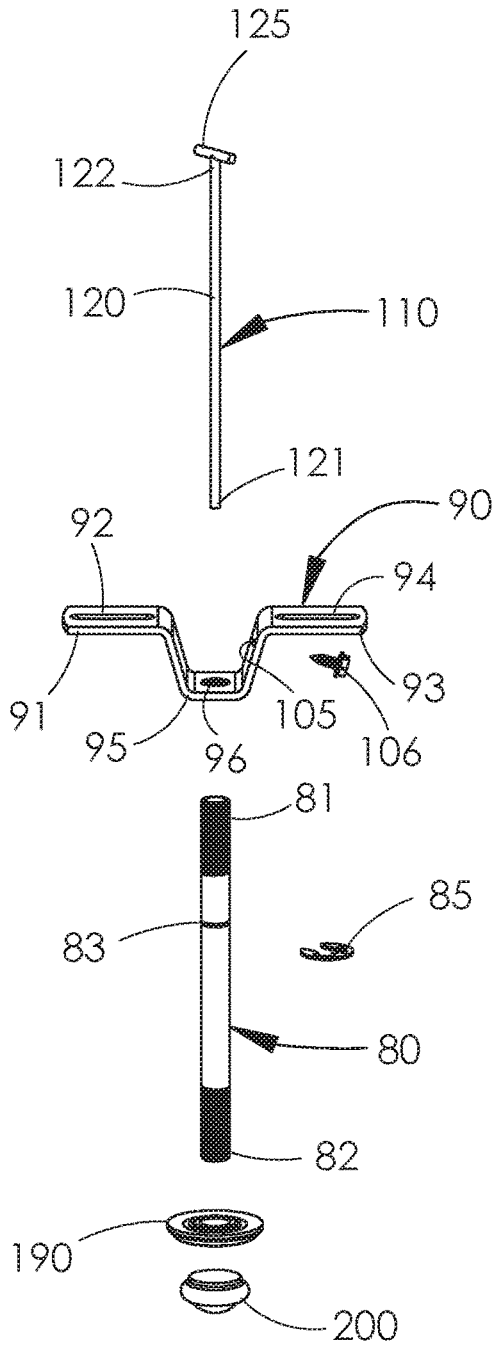
FIG. 13 is an exploded view of a guide, bracket and rod of an embodiment of the present invention.
Figure 14:
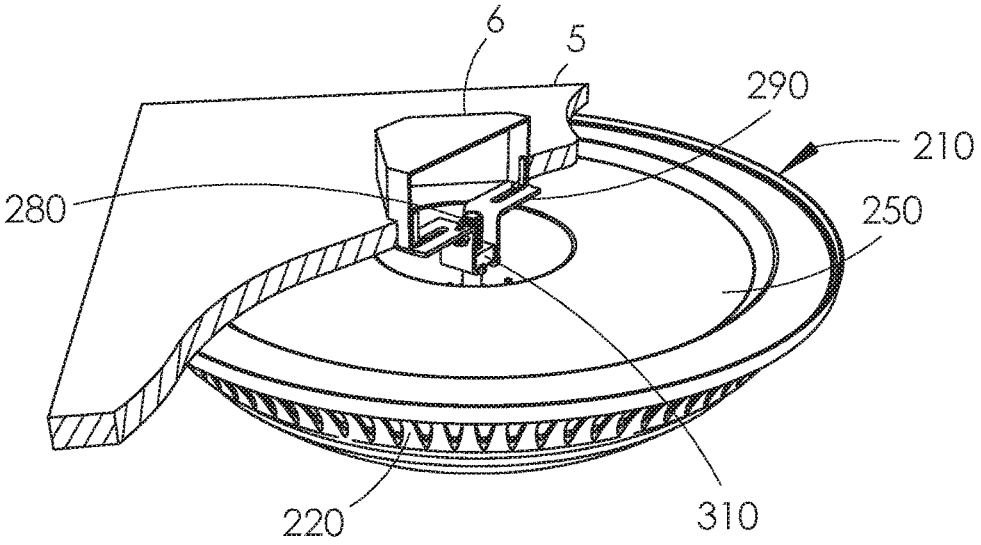
FIG. 14 is a perspective view of an alternative embodiment of the present invention shown flush against a ceiling.
Figure 15:
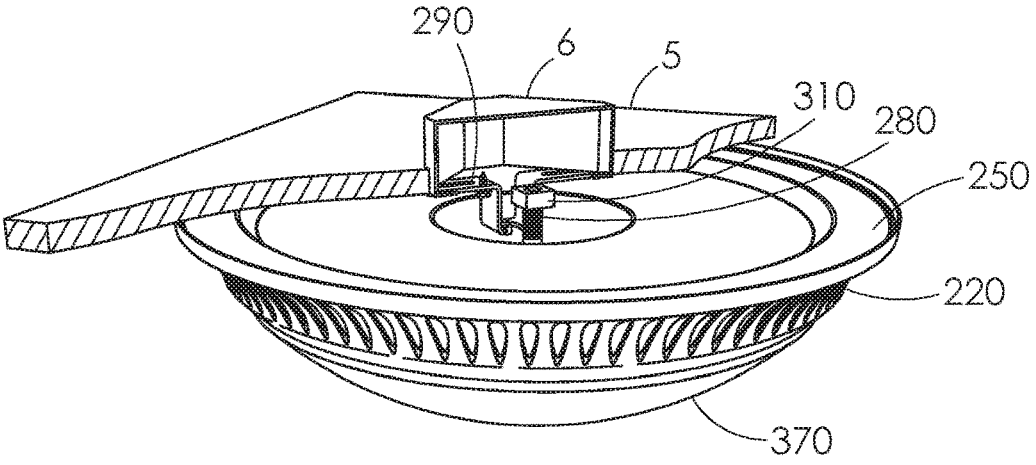
FIG. 15 is similar to FIG. 14, but shows a nut prior to being received by a bracket.

The lid 50, as seen in isolation in FIG. 7, has a perimeter 60 that is generally round. A lip 61 is upturned at the perimeter 60. The lip 61 preferably extends all the way around the perimeter. A step down 65 is provided between the perimeter 60 and a center 70. The step down separates an upper section near the perimeter 60 and a lower section near the center 70. The upper and lower sections can be generally parallel to each other. The lower section allows for clearance for wires and other electrical components. The center 70 has a cone 71 with a bottom 72. The cone 70 provides clearance for a bracket (described below). The bottom has a hole 73 there through. Holes 75 are spaced around the hole 73. There are preferably four holes 75 spaced about hole 73. However, it is appreciated that there could be more or fewer posts without departing from the broad aspects of the present invention. There are also two holes 76 that allow the electrical wires to pass through.

The rod 80, best seen in FIGS. 2-4, 6 and 13, has two opposed ends 81 and 82. A channel 83 is formed into an outer side wall between the ends. The channel 83 is formed as a groove around the outside of the rod. A clip 85 can be removably secured to the channel 83.

The bracket 90, as seen in FIGS. 1-6 and 13, has a first end 91 with a slot 92 formed there through. The bracket 90 also has a second end 93 with a slot 94 formed there through. A center 95 is formed and is located below the ends 91 and 93. The center 95 has a hole 96 there through. The hole 96 is preferably threaded with threads. A screw hole 105 for receiving a screw 106 suitable for grounding is further provided.

The bracket 90 preferably has a drop of approximately 1 inch between the ends 91 and 93, and the center 95. This is about 0.5 inches more than a standard bracket 90. It is appreciated that the bracket 90 could have a drop of more or less than one inch without departing from the broad aspects of the present invention. The center 95 of the bracket 90 can be received within the cone 71 of the lid 50 in this illustrated embodiment. In one alternative embodiment, the drop off to the center can be several inches so that the bracket can be used in the well of a recessed lighting mount.

A guide 110, as seen in FIGS. 1-6 and 13, has a body 120. The body has ends 121 and 122. A keeper 125 is located at end 122. The body 120 is preferably straight between the ends 121 and 122. The keeper 125 is preferably perpendicular to the longitudinal axis of the body 120.

Electronics 130 are best illustrated in FIGS. 1-4, 6 and 10. Electronics 130 has a board 140 with a perimeter 141. Several holes 142 are spaced about the perimeter 141. The perimeter is preferably generally square shaped and there are preferably two holes 142 on each side. The board 140 also has a center 143 with a central hole 144. Four holes 145 are preferably spaced about central hole 144. Electronic components 150, LEDs 155 and wires 157 are further provided.

Looking now to FIGS. 2-4, 6 and 9, it is seen that a heat sink 160 is provided. The heat sink 160 has a body 161 with a generally round and ring shaped profile. Several fins 162 upstand from the body. There are preferably 56 fins in a preferred embodiment. However, it is understood that there could be more or fewer fins without departing from the broad aspects of the present invention. It is also understood that while a preferred material is metal, that other materials and shapes resulting in satisfactory heat dissipation can be used without departing from the broad aspects of the present invention.

Air can flow through vents in the spacer 30 to remove heat dissipated by the heat sinks.

A lifter 165, as seen in FIGS. 2-4, 6 and 11, has a shaft 166, a flange 167 and a plurality of posts 169 or prongs. The shaft 166 is preferably hollow and has a bore through its longitudinal axis. The bore has a bore axis and an internal diameter. The flange 167 is connected to one end of the shaft 166. The flange has a central hole 168 that is aligned with the bore. The hole 168 has a diameter that is smaller than the bore diameter. There are preferably four gussets connecting the shaft 166 and flange 167. There are preferably four posts 169, or prongs, equally spaced and upstanding from the flange 167. Two holes 1680 are provided for allowing electrical wires 157 to pass through.

The cover 170 is best illustrated in FIGS. 1-6 and 12. The cover 170 has a perimeter 171 having an upstanding lip 172. A center 173 is seen to have a hole 174 there through. A shaft 180, having ends 181 and 182 upstands from the center hole 174. The shaft 180 has a bore that is sized preferably the same as a diameter of the center hole 174.

A washer 190 and bottom nut 200 are provided, and are best seen in FIGS. 1-6 and 13.

Turning now to the operation of this first illustrated embodiment of the present invention, it is seen how several of the individual components interact.

The lifter 165 slips over the end 181 of the cover. In this regard, end 181 contacts the inside of flange 167.

The cover 170 mates with the spacer 20. In this regard, the lip 172 of the cover 170 is received within the channel 34 of the bottom 33 of the spacer 20.

The posts 42 of the spacer are received in holes 142 of the board 140 of the electronics 130. The heat sink 160 is positioned on the top side of the board 140 of the electronics 130.

The posts or prongs 169 of lifter 165 are received through holes 145 of the board 140 and then through holes 75 on the cone 71 of the lid 50.

The guide 110 can be positioned with respect to the bracket 90. The body 120 of the guide 110 is placed through hole 96 and downwardly depends there from. The keeper 125 is longer than the hole 96 is wide thereby preventing the guide from fully passing through the hole.

The washer 190 and nut 200 are connected to one end 82 of the rod 80. The rod 80 is then positioned up through the bore in the shaft 180 of the cover and through the hole 168 through flange 167. The rod further passes through the hole 73 on the bottom of the cone 71 of the lid. Clip 85 is inserted into the channel 83. Doing this keeps the lid 50, board 140 and cover 170 positioned properly with each other between the clip 85 and the washer 190.

The end 121 of the body 120 is passed into the interior of the rod 80. In this regard, the rod 80 is guided by the guide 110 to engage the hole 96 of the bracket 90 (even though it is blind to the installer as the installer's vision can be obscured by the assembly 10). As the rod 80 is further threaded into the bracket 90, the end 81 of the rod 80 pushes the guide 110 vertically upwards relative to the bracket 90 wherein it rests unobtrusively after the installation is complete.

Turning now to FIGS. 14-20, it is seen that an alternative preferred embodiment of the present invention is illustrated. A light assembly 210, or simply assembly or fixture, is shown in relation to a ceiling 5 adjacent the recessed electrical box 6. The assembly 210 has a spacer 220, a lid 250, a rod 280 a bracket 290, a guide nut 310 (or simply nut), electronics 330, a heat sink 360, a lifter 365, a cover 370, a washer 390 and a nut 400. Each of these components are described in detail below. It is appreciated that these components are not all required components for each inventive aspect of the present invention.

The spacer 220 is best seen in FIGS. 14-17. Spacer 220 has a perimeter 230 that is preferably round in profile. The perimeter 230 has a top 231 with a catch 232. The perimeter 230 also has a bottom 233 with a channel 234. A sidewall 235 spans between the top 231 and bottom 233. The sidewall has a plurality of vents 236 spaced radially around the spacer 220. The sidewall 235 can be angled generally outwardly from bottom to top, so that the diameter is larger at the top 231 than at the bottom 233. A center 240 is provided. A preferably generally square opening 241 is provided. Posts are spaced about the hole or opening 241. There are eight posts in the preferred embodiment. However, there could be more or fewer without departing from the broad aspects of the present invention. The posts depend from the bottom 233 of the spacer and each have a longitudinal axis that is parallel to each other.

The lid 250, as seen in FIGS. 14-17, has a perimeter 260 that is generally round. A center 270 has a cone 271 with a bottom 272. The bottom has a hole 273 there through. Holes 275 are spaced around the hole 273. There are preferably four holes. However, it is appreciated that there could be more or fewer holes without departing from the broad aspects of the present invention. A step down is provided between the perimeter 260 and the center 270.

The rod 280, best seen in FIGS. 14-17, has two opposed ends 281 and 282. A channel 283 is formed into an outer side wall between the ends. The channel 283 is formed as a groove around the outside of the rod. A clip 285 can be removably secured to the channel 283.

The bracket 290, as seen in FIGS. 14-20, has a first end 291 with a slot 292 formed there through. The bracket 290 also has a second end 293 with a slot 294 formed there through. A center 295 is formed and is located below the ends 291 and 293. The center 295 has a slot 296 there through open to one side of the center section 295. The open end of the slot 296 preferably has ears 297 and 298. The center section 295 has sidewalls 299 and 300. Sidewalls 299 and 300 are preferably both planar and generally parallel to each other. A screw hole 305 for receiving a screw 306 suitable for grounding is further provided.

A nut 310, as seen in FIGS. 14-16 and 18-19, is provided and has a perimeter 311 and a hole 312. The perimeter is preferably generally square. It is appreciated that alternative perimeter shapes could be used without departing from the broad aspects of the present invention. It is nevertheless preferred that the perimeter has at least two sides that are generally parallel to each other.

Figure 17:
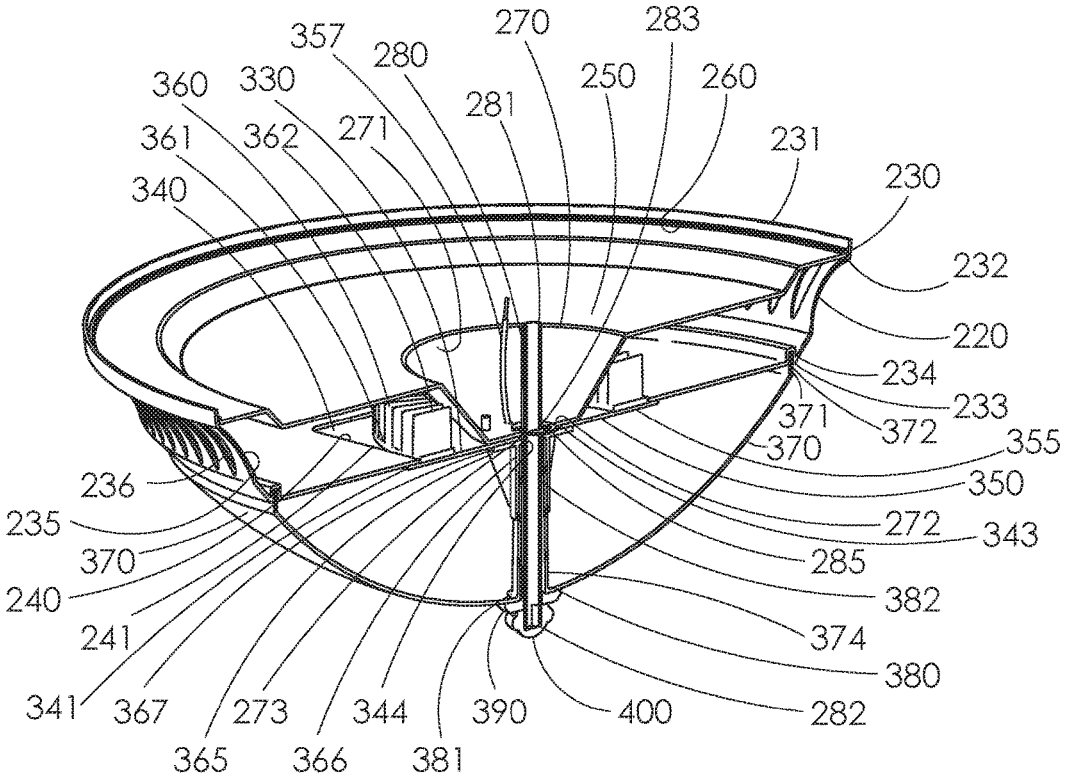
FIG. 17 is a cross-sectional view taken along line 17-17 in FIG. 16.
Figure 18:
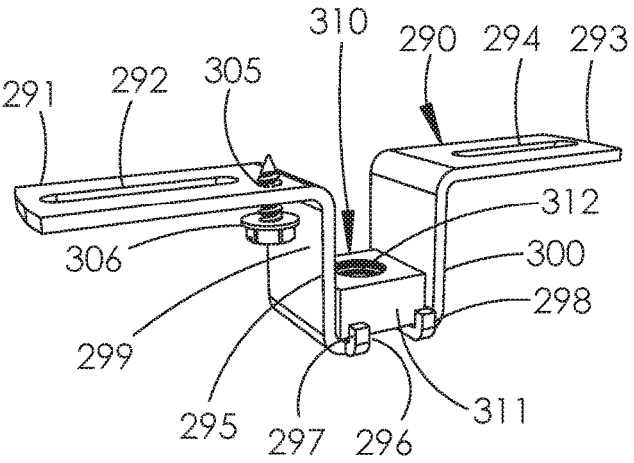
FIG. 18 is a perspective isolation view of an embodiment of a nut received within the bracket.
Figure 19:
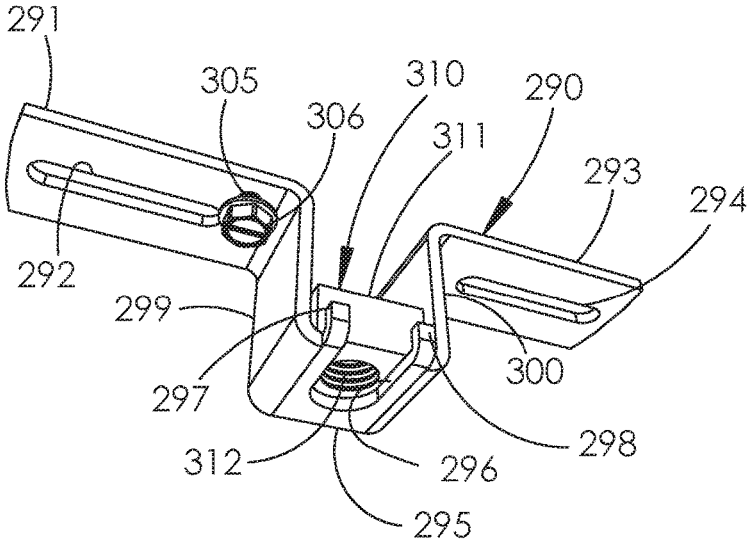
FIG. 19 is an alternative perspective view of the embodiment shown in FIG. 18.
Figure 20:
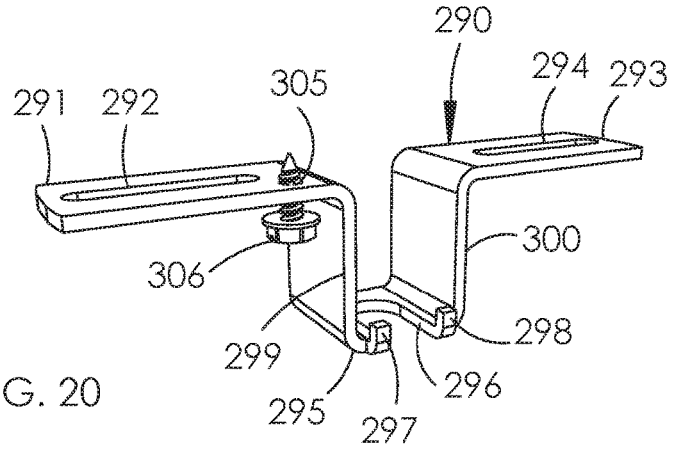
FIG. 20 is similar to FIG. 18, but shows the bracket without the nut.

The electronics 330 are best illustrated in FIG. 17. Electronics 330 has a board 340 with a perimeter 341. Several holes are spaced about the perimeter 341. The perimeter is preferably generally square shaped and there are preferably two holes on each side. The board 340 also has a center 343 with a central hole 344. Four holes are preferably spaced about central hole 344. Electronic components 350, LEDs 355 and wires 357 are further provided.

Looking now to FIG. 17, it is seen that a heat sink 360 is provided. The heat sink 360 has a body 361 with a generally round and ring shaped profile. Several fins 362 upstand from the body. There are preferably 56 fins in a preferred embodiment. However, it is understood that there could be more or fewer fins or alternative heat sinks without departing from the broad aspects of the present invention.

A lifter 365, as seen in FIG. 17, has a shaft 366, a flange 367 and a plurality of posts or prongs. The shaft 366 is preferably hollow and has a bore through its longitudinal axis. The bore has a bore axis and an internal diameter. The flange 367 is connected to one end of the shaft 366. The flange has a central hole that is aligned with the bore. The hole has a diameter that is smaller than the bore diameter. There are preferably four gussets connecting the shaft 366 and flange 367. There are preferably four posts equally spaced and upstanding from the flange 367.

The cover 370 is best illustrated in FIGS. 14-17. The cover 370 has a perimeter 371 having an upstanding lip 372. A center 373 is seen to have a hole 374 there through. A shaft 380, having ends 381 and 382 upstands from the center hole 374. The shaft 380 has a bore that is sized preferably the same as a diameter of the center hole 374.

Figure 16:
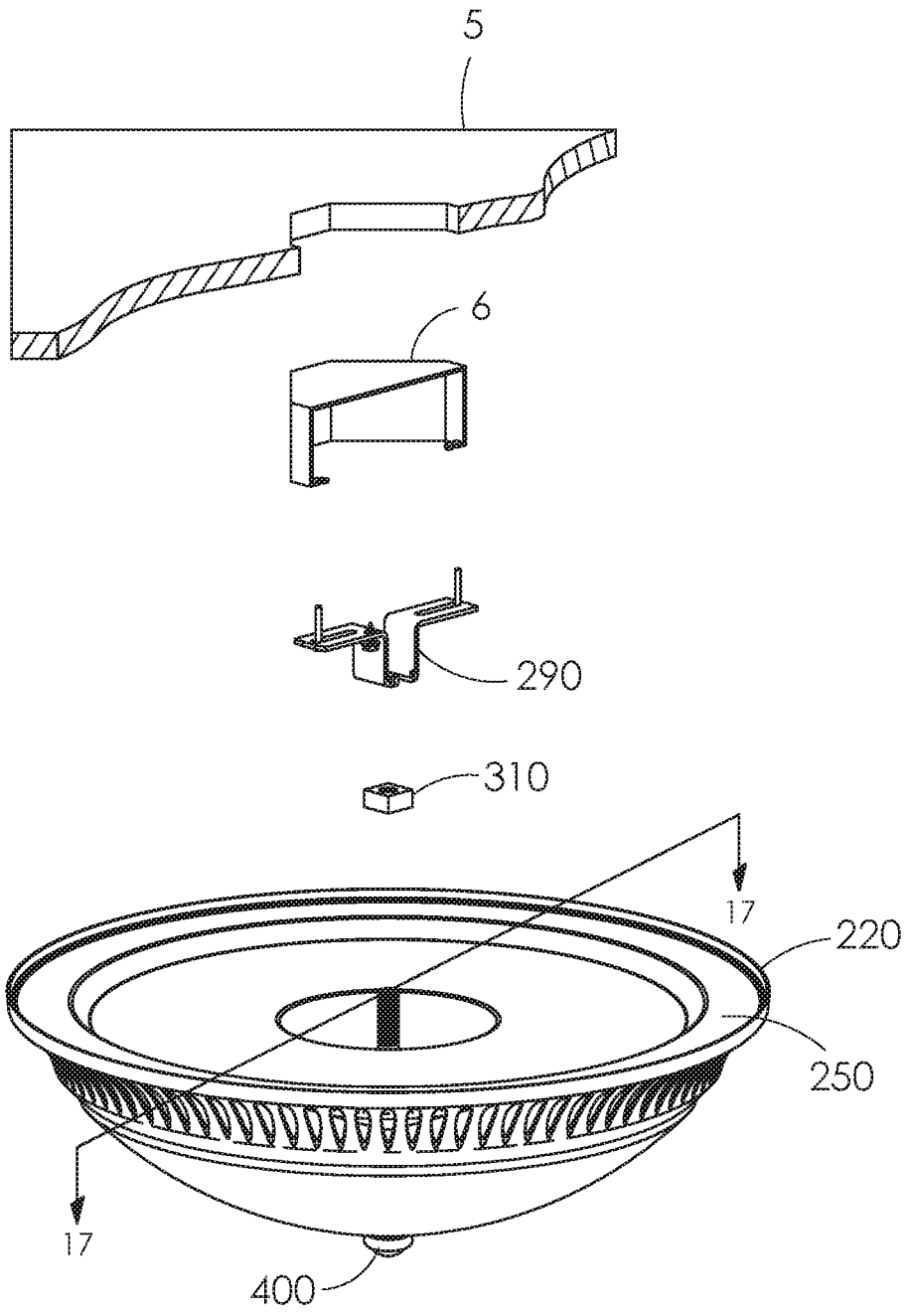
FIG. 16 is a partially exploded view of the embodiment illustrated in FIG. 14.

A washer 390 and bottom nut 400 are provided, and are best seen in FIGS. 16-17.

Turning now to the operation of this first illustrated embodiment of the present invention, it is seen how several of the individual components interact.

The lifter 365 slips over the end 382 of the cover. In this regard, end 382 contacts the inside of flange 367.

The cover 370 mates with the spacer 220. In this regard, the lip 372 of the cover 370 is received within the channel 234 of the bottom 233 of the spacer 220.

The posts of the spacer are received in holes of the board 340 of the electronics 330. The heat sink 360 is positioned on the top side of the board 340 of the electronics 330.

The washer 390 and nut 400 are connected to one end 282 of the rod 280. The rod 280 is then positioned up through the bore in the shaft 380 of the cover and through the hole through flange 367. The rod further passes through the hole 273 on the bottom of the cone 271 of the lid. Clip 285 is inserted into the channel 283. Doing this keeps the lid 250, board 340 and cover 370 positioned properly with each other between the clip 285 and the washer 390.

The nut 310 is threaded onto the end 281 of the rod 280. The nut 310 can then be seated upon the bracket 290. Contact between the rod 280 and the interior end of slot 296 of the bracket 290 prevents the rod and nut from escaping in one direction. The ears 297 and 298 prevent the nut 310 (and by extension, the rod) from escaping in the opposite direction (towards the open end of the slot). The sidewalls 299 and 300 engage the two remaining sides of the nut 310. In this regard, the nut is held rotationally stationary as the rod 280 is threadably advanced relative to the nut 310 (and bracket) to raise and lower the assembly 210 relative to the ceiling.

Figure 21:
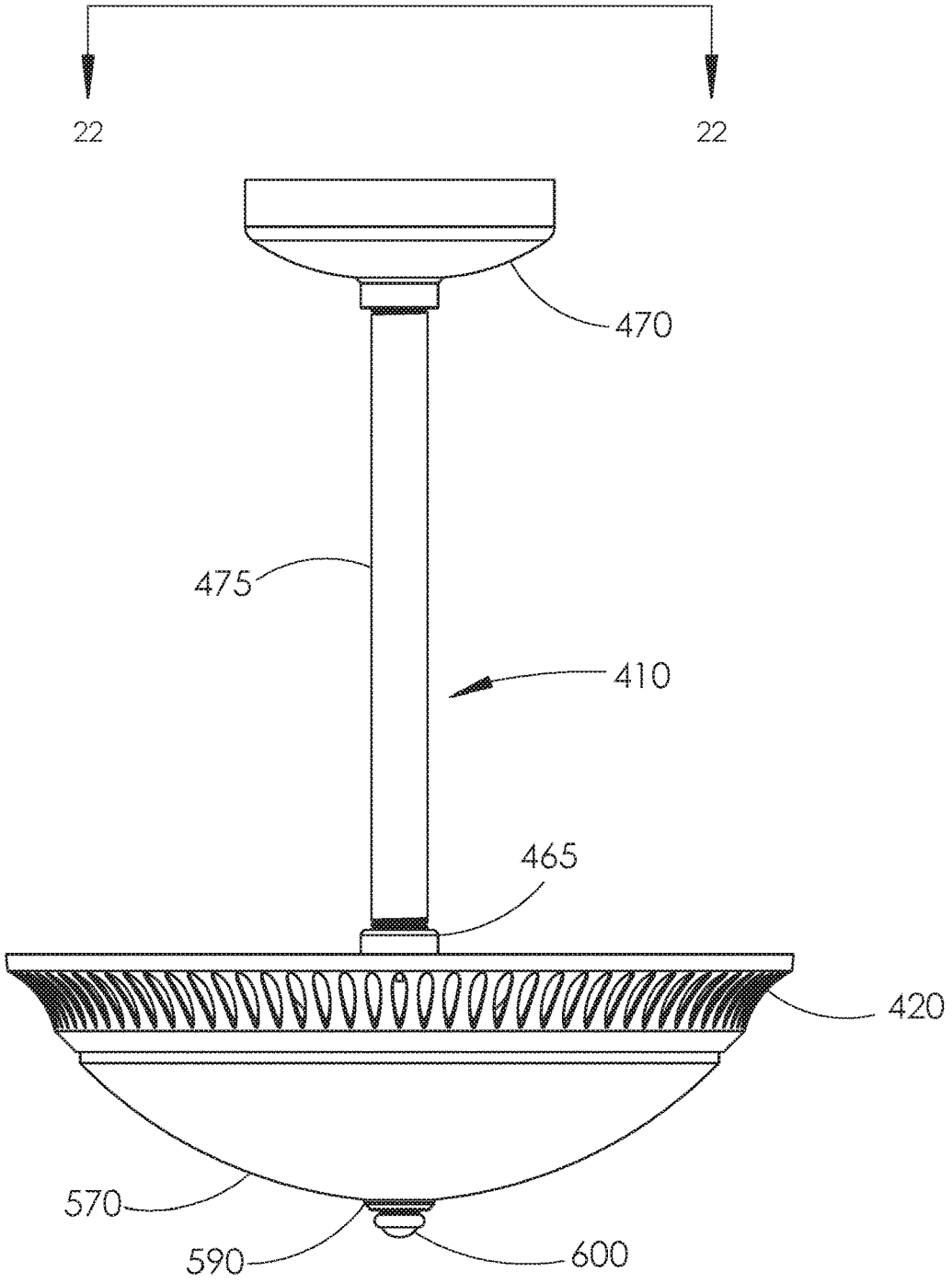
FIG. 21 is a side view of an alternative embodiment of the present invention.
Figure 22:
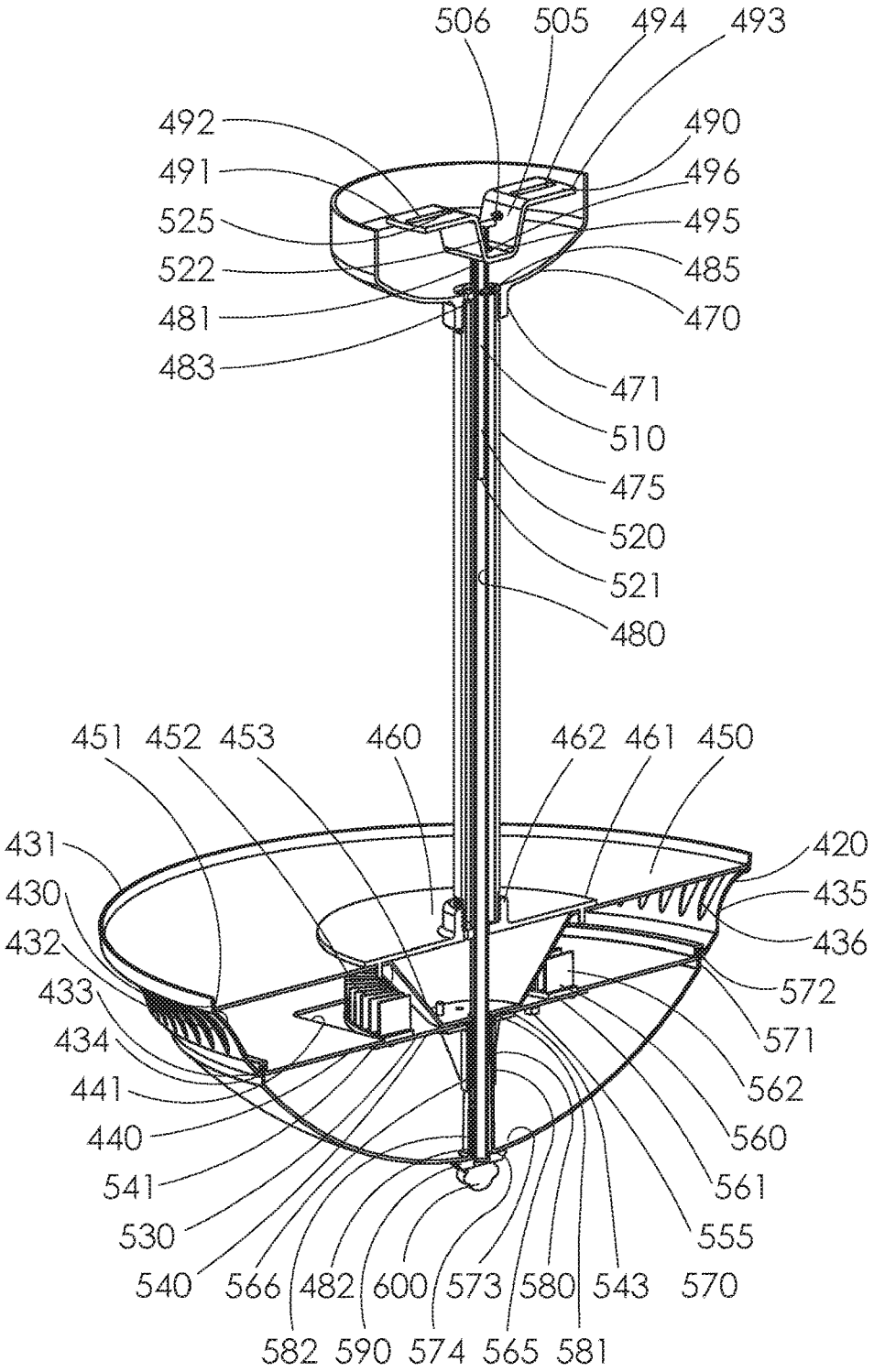
FIG. 22 is a cross-sectional view taken along line 22-22 in FIG. 21.
Figure 23:
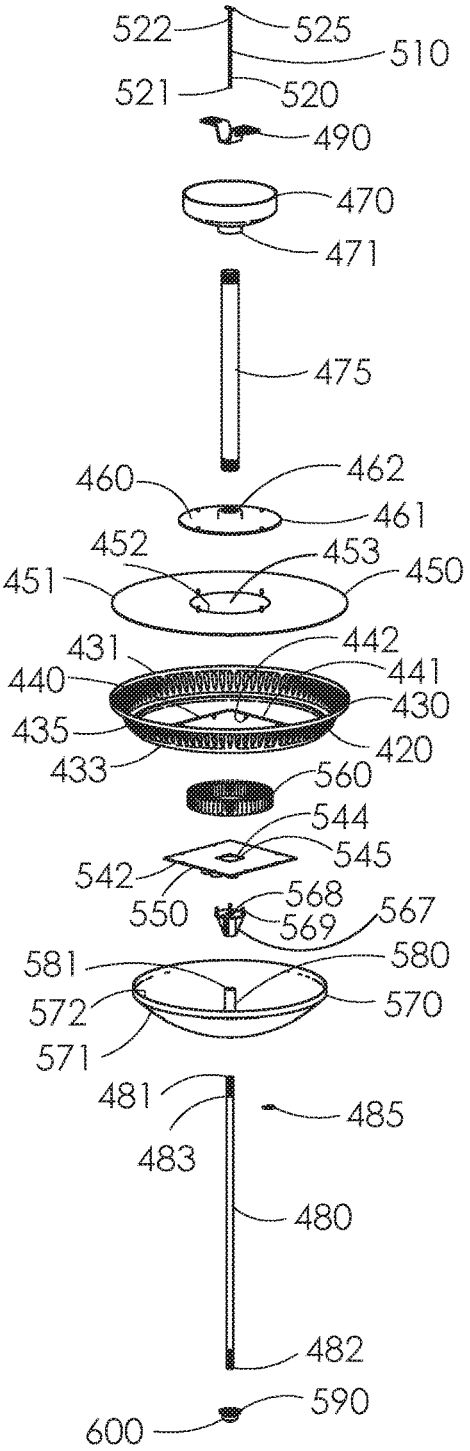
FIG. 23 is an exploded view of the embodiment illustrated in FIG. 21.

Turning now to FIGS. 21-23, it is seen that a further preferred embodiment of the present invention is illustrated. A light assembly 410, or simply assembly or fixture, is shown adjacent the recessed electrical box 6. The assembly 410 has a spacer 420, a lid 450, an insert 460, a bracket cover 470, a shaft 475, a rod 480 a bracket 490, a guide 510, electronics 530, a heat sink 560, a lifter 565, a cover 570, a washer 590 and a nut 600. Each of these components are described in detail below. It is appreciated that these components are not all required components for each inventive aspect of the present invention.

The spacer 420 has a perimeter 430 that is preferably round in profile. The perimeter 430 has a top 431 with a catch 432. The perimeter 430 also has a bottom 433 with a channel 434. A sidewall 435 spans between the top 431 and bottom 433. The sidewall has a plurality of vents 436 spaced radially around the spacer 420. The sidewall 435 can be angled generally outwardly from bottom to top, so that the diameter is larger at the top 431 than at the bottom 433. A center 440 is provided. A preferably generally square opening 441 is provided. Posts 442 are spaced about the hole or opening 441. There are eight posts 442 in the preferred embodiment. However, there could be more or fewer without departing from the broad aspects of the present invention. The posts depend from the bottom 433 of the spacer and each have a longitudinal axis that is parallel to each other.

The lid 450 has a perimeter 451 that is generally round. A center 452 is provided interior of the perimeter 451 and has a cone 453 depending therefrom.

The insert 460 has a perimeter 461 and a collar 462. The collar 462 is preferably internally threaded. A hole passes through the top on the bottom of the threaded collar The collar 462 is preferably generally centrally located on the top of the insert 460. The insert 460 covers the cone 453 of the lid 450. Several holes are provided on the insert 460 that can receive the corresponding posts from the lid 450 so that the lid and insert can stay in position relative to each other.

A bracket cover 470 is provided having an inside that can cover the bracket 490 and an outside. A collar 471 is on the bottom of the outside of the bracket cover 470. A hole passes through the bracket cover 470 at the base of the collar.

A shaft 475 is further provided. The shaft has two ends and is hollow with a bore between the ends. Each of the ends are preferably externally threaded with threads. One end of the shaft is threadably receivable within collar 462 and the opposite end is threadably receivable within collar 471.

The rod 480 has two opposed ends 481 and 482. A channel 483 is formed into an outer side wall between the ends. The channel 483 is formed as a groove around the outside of the rod. A clip 485 can be removably secured to the channel 483.

The bracket 490 has a first end 491 with a slot 492 formed there through. The bracket 490 also has a second end 493 with a slot 494 formed there through. A center 495 is formed and is located below the ends 491 and 493. The center 495 has a hole 496 there through. The hole 496 is preferably threaded with threads. A screw hole 505 for receiving a screw 506 suitable for grounding is further provided.

A guide 510 has a body 520. The body has ends 521 and 522. A keeper 525 is located at end 522. The body 520 is preferably straight between the ends 521 and 522. The keeper 525 is preferably is perpendicular to the longitudinal axis of the body 520.

Electronics 530 comprises a board 540 with a perimeter 541. Several holes 542 are spaced about the perimeter 541. The perimeter is preferably generally square shaped and there are preferably two holes 542 on each side. The board 540 also has a center 543 with a central hole 544. Four holes 545 are preferably spaced about central hole 544. Electronic components 550, LEDs 555 and wires are further provided.

The heat sink 560 has a body 561 with a generally round and ring shaped profile. Several fins 562 upstand from the body. There are preferably 56 fins in a preferred embodiment. However, it is understood that there could be more or fewer fins without departing from the broad aspects of the present invention.

The lifter 565 has a shaft 566, a flange 567 and a plurality of posts 569 or prongs. The shaft 566 is preferably hollow and has a bore through its longitudinal axis. The bore has a bore axis and an internal diameter. The flange 567 is connected to one end of the shaft 566. The flange has a central hole 568 that is aligned with the bore. The hole 568 has a diameter that is smaller than the bore diameter. There are preferably four gussets connecting the shaft 566 and flange 567. There are preferably four posts 569 equally spaced and upstanding from the flange 567.

The cover 570 has a perimeter 571 having an upstanding lip 572. A center 573 is seen to have a hole 574 there through. A shaft 580, having ends 581 and 582 upstands from the center hole 574. The shaft 580 has a bore that is sized preferably the same as a diameter of the center hole 574.

A washer 590 and bottom nut 600 are provided.

Turning now to the operation of this first illustrated embodiment of the present invention, it is seen how several of the individual components interact.

The lifter 565 slips over the end 582 of the cover. In this regard, end 582 contacts the inside of flange 567.

The cover 570 mates with the spacer 420. In this regard, the lip 572 of the cover 570 is received within the channel 434 of the bottom 433 of the spacer 420.

The posts 442 of the spacer are received in holes 542 of the board 540 of the electronics 530. The heat sink 560 is positioned on the top side of the board 540 of the electronics 530.

The guide 510 can be positioned with respect to the bracket 490. The body 520 of the guide 510 is placed through hole 496 and downwardly depends there from. The keeper 525 is longer than the hole 496 is wide thereby preventing the guide from fully passing through the hole.

The washer 590 and nut 600 are connected to one end 481 of the rod 480. The rod 480 is then positioned up through the bore in the shaft 580 of the cover and through the hole 568 through flange 567. The rod further passes through the hole on the bottom of the cone 459, through shaft 465 and through the bracket cover 460. Clip 485 is inserted into the channel 483. Doing this keeps the lid 450, board 540 and cover 570, bracket cover 460, insert 455 and shaft 465 positioned properly with each other between the clip 485 and the washer 590.

The end 521 of the body 520 is passed into the interior of the rod 480. In the regard, the rod 480 is guided by the guide 510 to engage the hole 496 of the bracket 490 (even though it is blind to the installer as the installer's vision can be obscured by the assembly 410). As the rod 480 is further threaded into the bracket 490, the end 481 of the rod 480 pushes the guide 510 vertically upwards relative to the bracket 490 wherein it rests unobtrusively after the installation is complete.

It is appreciated that in several embodiments, a rod is able to be directed into engagement with the bracket.

Thus it is apparent that there has been provided, in accordance with the invention, an improved light assembly and alignment device that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A bracket securable to an electrical box and used for installing a light assembly having a rod twistable with respect to a nut, said bracket comprising: a first end; a second end; and a central portion with a center, said central portion having a slot open to a side of said central portion between said first and said second end, wherein the slot has a slot width that is wider than a rod width, wherein the rod can pass laterally into said slot to be aligned with said center of said central portion of said bracket, wherein the rod that is threadably connected to the nut before the rod passes laterally into said slot, wherein said bracket has a first sidewall and a second sidewall, said first sidewall being parallel to said second sidewall, wherein the nut is selectably seated upon said bracket between said first sidewall and said second sidewall wherein said first sidewall and said second sidewall engage the nut to prevent the nut from twisting as the rod twist, thereby allowing the rod to translate with respect to said bracket by twisting the rod.

2. The bracket of claim 1 further comprising at least one arm, wherein:

said slot has an interior end, contact of the rod with said interior end prevents the rod from escaping the bracket in a first direction; and contact of the nut and said at least one arm prevents the rod from laterally escaping the bracket in a second direction that is generally opposite of said first direction.

3. An assembly comprising:

a bracket having a central hole threaded with bracket threads;

a rod having a threaded end that is able to be directed into engagement with the bracket so that said threaded end can threadably engage said central hole, said rod having a hollow interior;

a guide supported by said bracket, said guide having a keeper above said bracket and a body depending from said bracket through said central hole, said rod being inserted onto said body so that said guide directs said rod into engagement with said central hole;

electronics; and a cover.

4. The assembly of claim 3 further comprising a spacer with vents.

5. The assembly of claim 3 further comprising a bottom nut, said bottom nut being connected to a rod bottom end, said bottom nut supporting said cover with a washer and is accessible from exterior of said cover.

6. The assembly of claim 5 wherein said cover has a cover lip, said cover lip being received within a rim of a spacer.

7. A bracket securable to an electrical box and used for installing a light assembly having a rod twistable with respect to a nut, said bracket comprising:

a first end;

a second end;

a central portion with a center, said central portion having a slot open to a side of said central portion between said first end and said second end, wherein the slot has a slot width that is wider than a rod width, wherein the rod can pass laterally into said slot to be aligned with said center of said central portion of said bracket; and at least one arm, wherein:

said slot has an interior end, contact of the rod with said interior end prevents the rod from escaping the bracket in a first direction; and contact of the nut and said at least one arm prevents the rod from laterally escaping the bracket in a second direction that is generally opposite of said first direction.

* * * * *